US008270888B2

(12) United States Patent
Fujino

(10) Patent No.: US 8,270,888 B2
(45) Date of Patent: Sep. 18, 2012

(54) IMAGE HEATING APPARATUS

(75) Inventor: Takeshi Fujino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 12/853,594

(22) Filed: Aug. 10, 2010

(65) Prior Publication Data

US 2011/0052280 A1 Mar. 3, 2011

(30) Foreign Application Priority Data

Aug. 17, 2009 (JP) ..... 2009-188458

(51) Int. Cl.
*G03G 15/20* (2006.01)

(52) U.S. Cl. ..... 399/329; 399/328; 399/330

(58) Field of Classification Search ..... 399/328, 399/329, 330, 331, 334; 219/619
See application file for complete search history.

(56) References Cited

U.S. PATENT DOCUMENTS 6,049,691 A * 4/2000 Abe et al. ..... 399/330
7,263,305 B2 8/2007 Fujino
7,447,474 B2 11/2008 Fujino
7,522,870 B2 4/2009 Fujino
7,565,102 B2 * 7/2009 Suzuki ..... 399/328
2009/0003900 A1 1/2009 Shimizu et al.
2009/0180793 A1 7/2009 Fujino

FOREIGN PATENT DOCUMENTS

JP 2003-91185 3/2003
JP 2008-115014 5/2008

* cited by examiner

*Primary Examiner* — Hoang Ngo
(74) *Attorney, Agent, or Firm* — Fitzpatrick, Cella, Harper & Scinto

(57) ABSTRACT

An image heating apparatus includes a rotatable image heater including: an electroconductive layer; a pressor, press-contacting the heater, for forming a nip in which an image on a recording material is to be heated; an urging member, provided inside the heater, for urging the heater toward the pressor; and an excitation coil for induction-heating the electroconductive layer. When the length of the heater with respect to a rotational axis direction thereof is Lb, the length of the pressor with respect to the rotational axis direction is Lr, the outside distance of bent portions of the coil at both end portions thereof with respect to the rotational axis direction is LcoilA, and the inside distance of the bent portions with respect to the rotational axis direction is LcoilB, the lengths Lb and Lr and the distance LcoilA and LcoilB satisfy the following relationship:

LcoilA>Lb>Lr>LcoilB.

5 Claims, 6 Drawing Sheets

IMAGE HEATING APPARATUS

FIELD OF THE INVENTION AND RELATED ART

The present invention relates to an image heating apparatus for heating an image on a recording material.

In the image forming apparatus employing an electrophotographic method, as a fixing device (apparatus) for heat-fusing and fixing an unfixed toner image formed and carried on the recording material, those of various types have been conventionally proposed. As one of such fixing devices, there is an electromagnetic induction heating type fixing device. In this fixing device, as a means for heating a fixing member as an image heating member, a constitution in which an electroconductive layer is provided in the fixing member and is heated by electromagnetic induction heating has been known. In the electromagnetic induction heating type fixing device a device for generating a fluctuating magnetic field is disposed opposite to the electroconductive layer and generates magnetic flux which penetrates the electroconductive layer. As a result, an eddy current is generated in the electroconductive layer to cause heat generation. According to the electromagnetic induction heating, the electroconductive layer can be caused to generate heat in a very short time and the fixing member can be directly heated. For this reason, compared with the case where a heat generating member such as a halogen lamp or the like is used as a heating source, it is possible to efficiently perform warming-up of the apparatus. Further, the excitation coil for generating the magnetic field can also be disposed either of inside or outside the fixing member so as to oppose the electroconductive layer, so that design latitude is increased. As the fixing member for such a fixing device, for the purpose of further reducing the rise time of the temperature, e.g., a fixing device using an endless belt having small thermal capacity and wide latitude in arrangement has been proposed as in an embodiment described in Japanese Laid-Open Patent Application 2003-91185. This fixing device includes a fixing belt having an endless circumferential surface, a pressing roller (pressing member) contactable to the outer circumferential surface, and a pressing pad disposed inside the belt and contacting a rear surface side of the belt where it opposes the pressing roller through the belt for urging the belt against the pressing roller. Further, the fixing device also includes a pad supporting member for supporting the pressing pad, an electromagnetic induction heating device provided along the outer circumferential surface of the belt for heating the belt, and a guide member contacting an inner circumferential surface of the belt at its side edge portions. In this fixing device, meandering of the belt is prevented by the guide member while urging the pressing roller with the pressing pad. For that reason, when the entire stress applied from three members of the pressing roller toward the end portions of the belt concentrates at the belt end portions, there is a possibility that the belt is liable to be broken by the stress. In order to relieve the stress, the pressing roller is configured so that the end portions of the pressing roller do not contact the guide member located at the end portions of the fixing belt. That is, at the end portions of the belt, a portion at which the pressing roller does not contact the belt is present.

However, the above-described prior art is accompanied by the following problem. That is, the non-contact portion of the pressing roller is present at the belt end portions but a heating area by the electromagnetic induction heating device shows a moderate reduction tendency to some extent at end portions of the heating area. For this reason, in the case where the heating area extends to the non-contact portion of the pressing roller, there is a possibility that the temperature of the non-contact portion of the pressing roller with the belt is gradually increased during continuous sheet passing. For that reason, the heat is finally required to be stopped so that the temperature does not exceed a heat-proof (heat-resistant) temperature of the belt which is the fixing member, but there is a possibility that it results in a lowering in productivity.

On the other hand, a constitution in which the heating apparatus by the electromagnetic induction heating device does not extend to the non-contact portion of the pressing roller is employed, a lowering in temperature in the sheet passing area is liable to occur.

For that reason, in the above-described image forming apparatus of the electromagnetic induction heating type, a constitution capable of decreasing a fluctuation in widthwise temperature distribution of the image heating member having the non-contact portion (area) of the pressing roller has been desired.

SUMMARY OF THE INVENTION

A principal object of the present invention is to provide an image heating apparatus capable of decreasing a fluctuation in temperature distribution of an image heating member with respect to a widthwise direction of the image heating member.

Another object of the present invention is to provide an image forming apparatus including the image heating apparatus.

According to an aspect of the present invention, there is provided an image heating apparatus comprising:

a rotatable image heating member including an electroconductive layer;

a pressing member, press-contacting the image heating member, for forming a nip in which an image on a recording material is to be heated;

an urging member, provided inside the image heating member, for urging the image heating member toward the pressing member; and an excitation coil for induction-heating the electroconductive layer, wherein when the length of the image heating member with respect to a rotational axis direction of the image heating member is Lb, the length of the pressing member with respect to the rotational axis direction is Lr, the outside distance of bent portions of the excitation coil at both end portions of the excitation coil with respect to the rotational axis direction is LcoilA, and the inside distance of the bent portions with respect to the rotational axis direction is LcoilB, the lengths Lb and Lr and the distance LcoilA and LcoilB satisfy the following relationship:

$$LcoilA>Lb>Lr>LcoilB.$$

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described based on several preferred embodiments with reference to the drawings but is not limited thereto.

Embodiment 1

(1) Image Forming Apparatus

Figure 1:
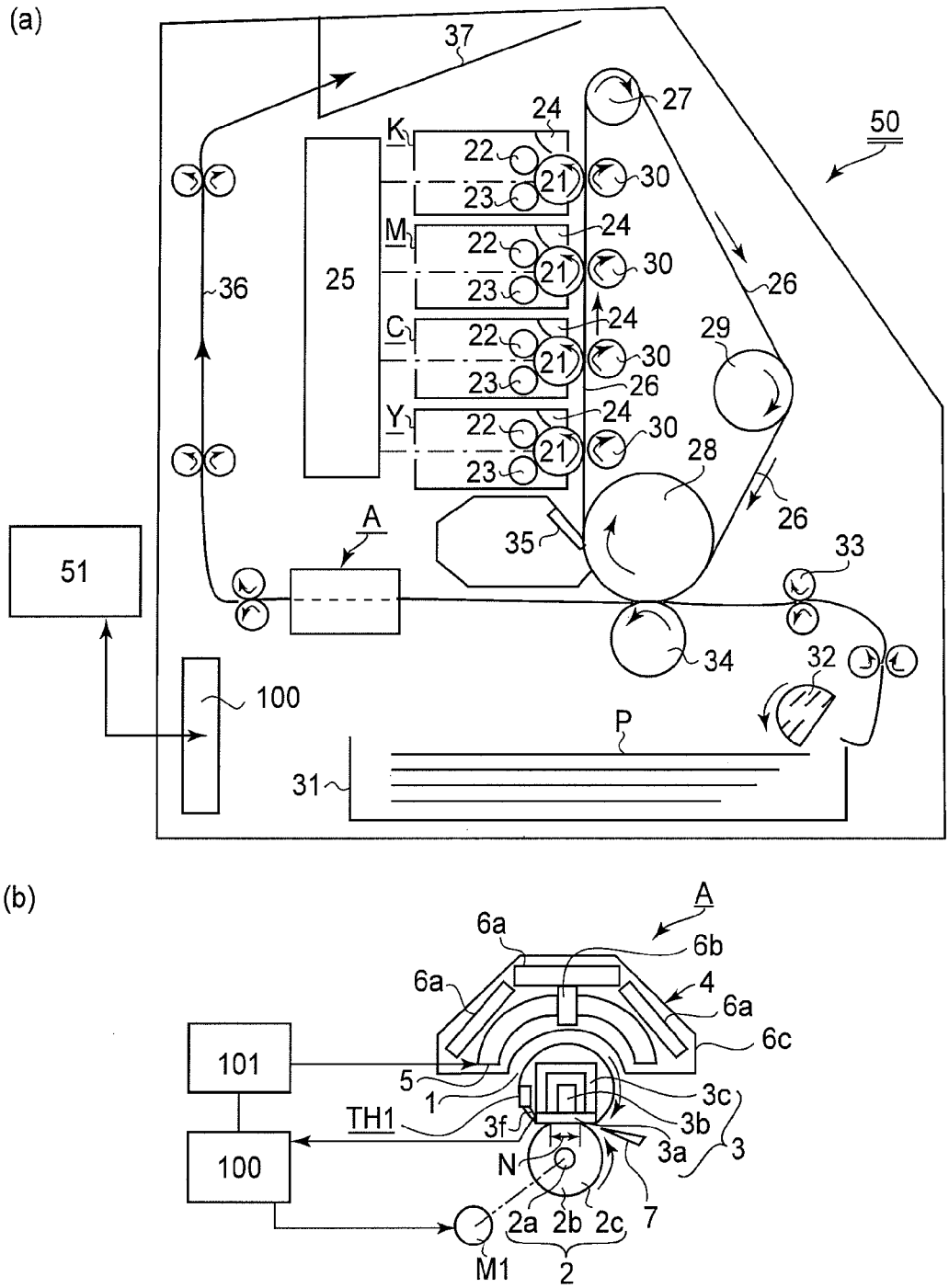
FIG. 1(*a*) is a schematic view of an image forming apparatus in Embodiment 1, and FIG. 1(*b*) is an enlarged cross-sectional side view of a principal part of a fixing device (image heating apparatus) and a control block diagram in Embodiment 1.

FIG. 1(*a*) is a schematic view of an example of an image forming apparatus 50 in which an image heating apparatus A according to the present invention is mounted as a fixing device. This image forming apparatus 50 is a color printer using an electrophotographic method. The image forming apparatus 50 forms a color image on a sheet-like recording material P as a recording medium on the basis of an electrical image signal input from an external host device 51, such as a personal computer or an image reader, into a control circuit portion (control means) 100 on an image forming apparatus side. The control circuit portion 100 includes a CPU (operation unit), ROM, etc., and transfers various pieces of electrical information between itself and the host device 51 or an operating portion (not shown) of the image forming apparatus 50. Further, the control circuit portion 100 effects centralized control of an image forming operation of the image forming apparatus 50 in accordance with a predetermined control program or a predetermined reference table.

Y, C, M and K represent four image forming stations (portions) for forming color toner images of yellow, cyan, magenta, and black, respectively, and are arranged in this order from a lower portion to an upper portion in the image forming apparatus 50. Each of the image forming stations, Y, C, M, and K includes an electrophotographic photosensitive drum 21, which is an image bearing member, and includes, as process means acting on the drum 21, a charging device 22, a developing device 23, a cleaning device 24, and the like.

In the developing device 23 for the yellow image forming station Y, yellow toner is accommodated. In the developing device 23 for the cyan image forming station C, cyan toner is accommodated. In the developing device 23 for the magenta image forming station M, cyan toner is accommodated. In the developing device 23 for the black image forming station K, black toner is accommodated.

An optical system 25 for forming an electrostatic latent image by subjecting each of the drums 21 to exposure to light is provided correspondingly to the above-described four color image forming stations Y, C, M and K. As the optical system, 25, a laser scanning exposure optical system is used.

At each of the image forming stations, Y, C, M and K, the photosensitive drum 21 electrically charged uniformly by the charging device 22 is subjected to scanning exposure on the basis of image data by the optical system 25. As a result, an electrostatic latent image corresponding to a scanning exposure image pattern is formed on the drum surface.

The resultant electrostatic latent images are developed into the toner images by the developing devices 23. That is, a yellow toner image corresponding to a yellow component image of a full-color image is formed on the drum 21 for the yellow image forming station Y. A magenta toner image corresponding to a magenta component image of the full-color image is formed on the drum 21 for the magenta image forming station M. A magenta toner image corresponding to a magenta component image of a full-color image is formed on the drum 21 for the magenta image forming station M. A black toner image corresponding to black component image of the full-color image is formed on the drum 21 for the black image forming station K.

The above-described color toner images formed on the drums 21 for the respective image forming stations Y, C, M and K are successively primary-transferred superposedly onto an intermediary transfer member 26, rotated in synchronism with and at the substantially the same speed as the rotation of the respective photosensitive drums 21, in a predetermined alignment state. As a result, unfixed full-color toner images are synthetically formed on the intermediary transfer member 26. In this embodiment, as the intermediary transfer member 26, an endless intermediary transfer belt is used and is stretched around three rollers consisting of a driving roller 27, a secondary transfer opposite roller 28, and a tension roller 29, thus being driven by the driving roller 27.

As a primary transfer means for transferring the toner image from the drum 21 for each of the image forming stations Y, C, M and K onto the belt 26, a primary transfer roller 30 is used. To the roller 30, a primary transfer bias of a polarity opposite to that of the toner is applied from an unshown bias power source. As a result, the toner image is primary-transferred from the drum 21 for each of the image forming stations Y, C, M and K onto the belt 26. After the primary-transfer from the drum 21 onto the belt 26 at each of the image forming stations Y, C, M and K, toner remaining on the drum 21 as transfer residual toner is removed by the cleaning device 24.

The above-described steps are performed with respect to the respective colors of yellow, cyan, magenta, and black in synchronism with the rotation of the belt 26 to successively superposed and form the primary-transfer toner images for the respective colors on the intermediary transfer belt 26. Incidentally, during image formation for only a single color (in a single color mode), the above-described steps are performed for only an objective color.

A recording material P in a recording material cassette 31 is separated and fed by a feeding roller 32 one by one with predetermined timing. The fed recording material P is conveyed, with predetermined timing by registration rollers 33, to a transfer nip (portion) which is a press-contact portion between a secondary transfer roller 34 and an intermediary transfer belt portion extended around the secondary transfer opposite roller 28.

The primary-transfer synthetic toner images formed on the belt 26 are simultaneously transferred onto the recording material P by a bias, of a polarity opposite to that of the toner, applied from an unshown bias power source to the secondary transfer roller 34. After the secondary transfer, secondary-transfer residual toner remaining on the belt 26 is removed by an intermediary-transfer-belt cleaning device 35.

The toner images secondary-transferred onto the recording material P are fixed through fusing and mixing on the recording material P by the fixing device A as the image heating apparatus, so that the recording material P is sent, as a full-color print, to a sheet discharge tray 37 through a sheet discharge path 36.

(2) Fixing Device 100

In the following description, a length or longitudinal direction of a fixing device A or members constituting the fixing device A is a dimension or direction with respect to a direction parallel to a direction perpendicular to a recording material conveyance direction in a plane of a recording-material conveyance path. A widthwise direction is a direction parallel to the recording-material conveying direction.

With respect to the fixing device A, a front surface refers to a surface as seen from a recording-material entrance side, and a rear surface is a surface (a recording-material exit side) opposite from the front surface. The left (side) and the right (side) refer to left (side) and right (side) as seen from the front surface side. The upper (side or portion) and the lower (side or portion) refer to upper (side or portion) and lower (side or portion) with respect to the gravitational direction. An upstream side and a downstream side refer to an upstream side and a downstream side with respect to the recording-material conveyance direction.

Figure 2:
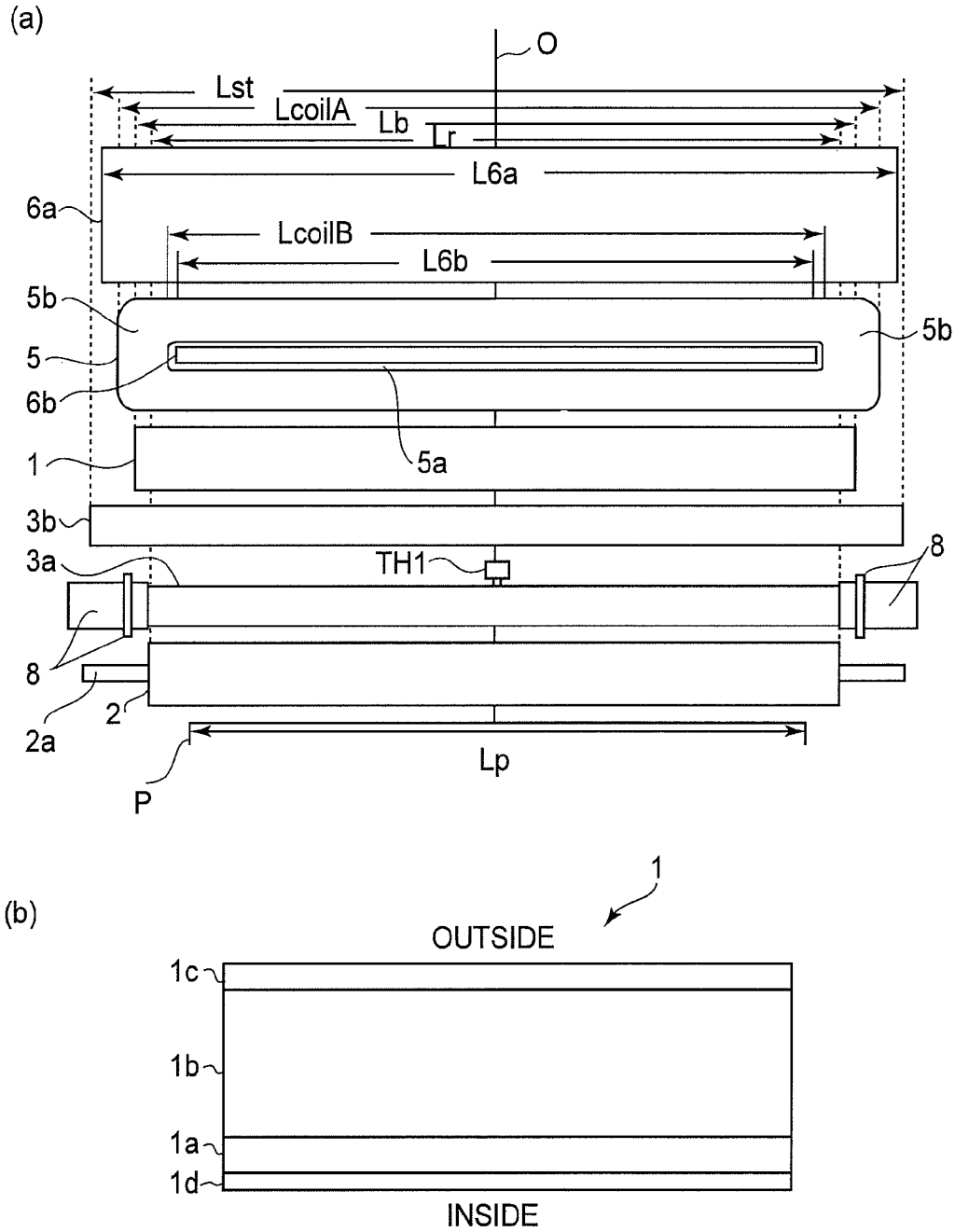
FIG. 2(*a*) is a schematic view showing a length relationship among constituent members which constitute the fixing device in Embodiment 1, and FIG. 2(*b*) is a schematic view showing a layer structure of a fixing belt.
Figure 4:
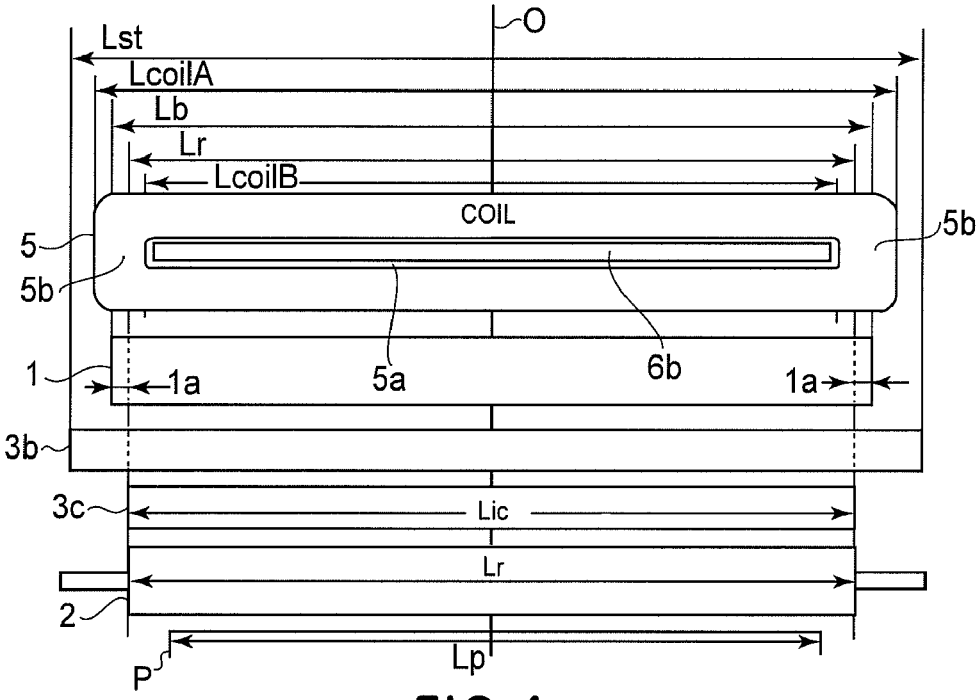
FIG. 4 is a schematic view showing a longitudinal relationship among the constituent members of the fixing device in Embodiment 1.

FIG. 1(*b*) is an enlarged cross-sectional side view of a principal part of the fixing device A as the image heating apparatus in this embodiment. FIG. 2(*a*) is a schematic view showing a length relationship among various members constituting the fixing device A. An endless fixing belt (endless belt) 1 as a rotatable image heating member (fixing member) has a metal layer as an electroconductive layer and is a flexible belt (having flexibility). An elastic pressing roller 2 as a rotatable pressing member for creating a fixing nip N which is a press-contact portion with the belt 1 is contactable to an outer peripheral surface of the belt 1. An urging member 3 is provided inside the belt 1 and is urged toward the roller 2. The urging member 3 is constituted by an urging member portion 3*a*, a metal stay 3*b* for supporting the urging member portion 3*a*, and a member shielding core 3*c* as a magnetic shielding member for covering the stay 3*b* in order to prevent a temperature rise by induction heating of the stay 3*b*. An induction heating device 4 as a heating source (induction heating means) for induction-heating the belt 1 includes an excitation coil 5 which is formed with Litz wire as an electric wire and is prepared by tightly folding and winding the wire in an elongated and ship bottom-like shape so as to oppose a part of the peripheral surface and side surface of the belt 1. Further, the induction heating device 4 includes an outside magnetic core 6*a* for covering the coil 5 so that a magnetic field generated by the coil 5 does not substantially leak into a portion except the metal layer (electroconductive layer) of the belt 1. Further, the induction heating device 4 also includes a central magnetic core 6*b* disposed at an inside hollow portion 5*a* (FIG. 2(*a*) and FIG. 4) of the coil 5. The induction heating device 4 further includes a mold member 6*c* for supporting the coil 5 and the cores 6*a* and 6*b* with an electrically insulative resin material. The induction heating device 4 is disposed opposed to an upper-side outer peripheral surface of the belt 1 with a predetermined generation (spacing).

The roller 2 is rotationally driven in a counterclockwise direction indicated by an arrow shown in FIG. 1(*b*) at a predetermined speed by a motor (driving means) M1 controlled by the control circuit portion 100. By a frictional force in the nip N between the roller 2 and the belt 1 generated by rotation of the roller 2, a rotational force acts on the belt 1. As a result, the belt 1 is rotated around the urging member 3 in a clockwise direction indicated by an arrow at a peripheral speed substantially corresponding to the rotational peripheral speed of the roller 2 while the inner surface thereof closely slides on the urging member portion 3*a* in the nip N. That is, the belt is rotated at the substantially same peripheral speed as a conveyance speed of the recording material P which is conveyed from an image transfer side and on which the unfixed toner images are carried. In this embodiment, the belt 1 is rotated at the surface rotated speed of 210 mm/sec, and the full-color image can be formed on the recording material P having an A4 size at a rate of 50 sheets/min. Further, in a rotation state of the belt 1, to the coil 5 of the induction heating device 4, a high-frequency current of 20-50 kHz is applied from an electric power unit (excitation circuit) 101. Then, by an alternating magnetic field generated by the coil 5, the metal layer (electroconductive layer) is induction-heated. A temperature sensor (temperature detecting element) TH1, such as a thermistor, is disposed in contact with the inner surface of the belt 1 at a substantially central portion with respect to a widthwise direction of the belt 1. Here, the widthwise direction of the belt 1 is the rotational axis direction of the belt 1. The sensor TH1 detects the temperature of the belt portion providing a sheet passing area of the recording material P and feeds back detected temperature information to the control circuit portion 100. The control circuit portion 100 controls electric power input from the electric power unit 101 into the coil 5 so that the detected temperature input from the sensor TH1 into the control circuit portion 101 is kept at a predetermined target temperature (fixing temperature). That is, in the case where the detected temperature of the belt 1 is increased to the predetermined temperature, energization to the coil 5 is shut off. In this embodiment, temperature control is made by controlling the electric power to be input into the coil 5 by changing the frequency of the high-frequency current on the basis of the detected value of the sensor TH1 so that the detected value is kept constant at 180° C. which is the target temperature of the belt 1. The sensor TH1 is attached to the urging member portion 3*a* through an elastic supporting member 3*f* and is configured so as to follow the positional variation of the belt 1, such as waving, even when positional variation occurs, thus being kept in a good contact state. In a state in which the roller 2 is rotationally driven and the belt 1 is raised to the predetermined fixing temperature and is temperature-controlled at the fixing temperature, the recording material P having thereon the unfixed toner images is guided and introduced into the nip N by a guide member 7 with its toner image carrying surface toward the belt 1. The recording material P closely contacts the outer surface of the belt 1 in the nip N and is nip-conveyed in the nip N together with the belt 1. As a result, the unfixed toner images are supplied with heat of the belt 1 principally and supplied with a pressing force in the nip N, thus being heat-fixed on the surface of the recording material P. The recording material P having passed through the nip N is conveyed to the outside of the fixing device A by self-separation thereof from the outer circumferential surface of the belt 1 by deformation of the belt surface at an exit portion of the nip N. Here, in the fixing device A in this embodiment, the conveyance of the recording material P is performed by a so-called center basis conveyance with a widthwise center (line) of the recording material P as a conveyance center (line). That is, recording materials, having any widthwise sizes, capable of being used in and passed through the fixing device A so that widthwise center portions of the recording materials pass through a widthwise center portion of the belt 1 with respect to the longitudinal direction of the belt 1. In FIG. 2(*a*), O represents a center reference (base) line (phantom line) for the recording material conveyance. Further, Lp represents a width of a maximum sheet passing area (maximum sheet passing size). In this embodiment, Lp is 300 mm.

1) Fixing Belt 1

FIG. 2(*b*) is a schematic view showing a layer structure of the belt 1. The belt 1 in this embodiment has a full length (width) Lb of 336 mm. The belt 1 has an inner diameter of 30 mm and includes a base layer (metal layer) 1*a* formed of nickel manufactured through electroforming to have a thickness of 40 μm.

At an outer peripheral surface of the base layer 1*a*, a heat-resistant silicone rubber layer is provided as an elastic layer 1*b*. The thickness of this silicone rubber layer may preferably be set within a range from 100 μm to 1000 μm. In this embodiment, the thickness of the silicone rubber layer 4*b* is set at 300 μm in consideration of the decreased thermal capacity of the belt 1 to shorten a warming-up time and the need to obtain a suitable fixation image during the fixation of the color images. The silicone rubber has a JIS-A hardness of 20 degrees and a thermal conductivity of 0.8 W/mK.

Further, at an outer peripheral surface of the elastic layer 1*b*, a fluorine-containing resin material layer (e.g., of PFA or PTFE) as a surface parting layer 1*c* is provided in a thickness of 30 μm.

On an inner surface side of the base layer 1*a*, in order to lower sliding friction between the inner surface of the belt 1 and the temperature sensor TH1 (FIG. 1(*b*)), a resin material layer (lubricating layer) 1*d* may be formed of a fluorine-containing resin material or polyimide and has a thickness of 10-50 μm. In this embodiment, as this layer 1*d*, a 20 μm-thick polyimide layer is provided.

As a material for the base layer 1*a* of the belt 1, other than nickel, an iron alloy, copper, silver or the like can be appropriately selectable. Further, the base layer 1*a* may also be constituted so that a layer of the metal or metal alloy described above is laminated on a resin material base layer. The thickness of the base layer 1*a* may be adjusted depending on the frequency of the high-frequency current caused to flow through an excitation coil described later and depending on magnetic permeability and electrical conductivity of the base layer 1*a* and may be set in a range from 5 μm to 200 μm.

2) Pressing Roller 2

The pressing roller 2 for forming the nip N between itself and the belt 1 has an outer diameter of 30 mm and includes an iron-made core metal 2*a* having a central portion diameter of 20 mm and end portion diameters of 19 mm with respect to the longitudinal direction, a silicone rubber layer as an elastic layer 2*b*, and a 30 μm-thick surface parting layer 2*c* of a fluorine-containing resin material layer (e.g., PFA or PTFE). The roller 2 has an ASKER-C hardness of 70 degrees at the central portion with respect to the longitudinal direction. The core metal 2*a* has a tapered shape. This is because a pressure in the nip between the belt 1 and the roller 2 is uniformized over the longitudinal direction even in the case where the urging member 3 is bent during pressure application. In this embodiment, the roller 2 has a length Lr of 320 mm.

Further, the width of the nip N between the belt 1 and the roller 2 with respect to the recording material conveyance direction is about 8 mm at the end portions of the nip N and about 7.5 mm at the central portion of the nip N with respect to the longitudinal direction. This has the advantage that the conveyance speed of the recording material P at the end portions with respect to the recording material width direction is higher than that at the central portion with respect to the recording material width direction to decrease the likelihood of the occurrence of a crease of the paper.

3) Urging Member 3

The urging member 3 is disposed inside the belt 1 is urged against the belt 1 toward the roller 2 at a pressure of 490 N (50 kgf) by a pressure-urging (applying) means (not shown). The pressure-urging means can select a contact state in which the urging member 3 press-contacts the belt 1 by a shifting mechanism (not shown) such as a cam mechanism or the like connected to a motor and a separation state in which the urging member 3 is separated from the belt 1 by the shifting mechanism.

Figure 3:
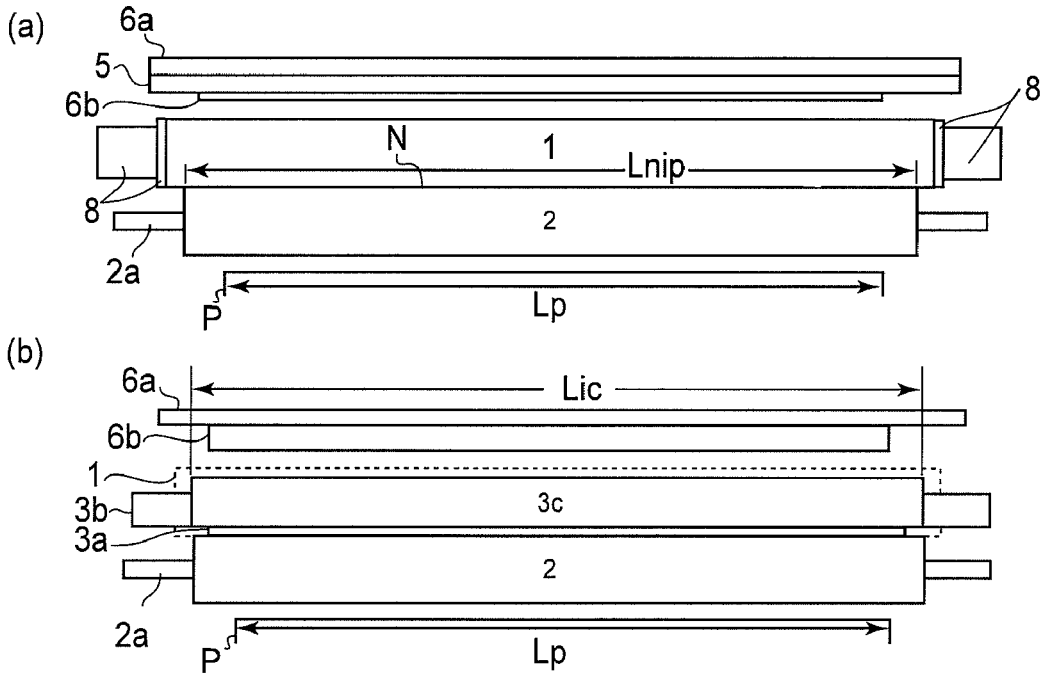
FIGS. 3(*a*) and 3(*b*) are schematic views each showing the fixing device in Embodiment 1.

As a result, it is possible to prevent the elastic layer 2*b* of the roller 2 and the belt 1 from being permanently deformed. The urging member 3 is constituted by the urging member portion 3*a* of the heat-proof resin material and the metal stay 3*b* for supporting the urging member portion 3*a*. The stay 3*b* is required to have rigidity in order to apply pressure in the nip N. For that reason, in this embodiment, the stay 3*b* is formed of iron. Further, the urging member portion 3*a* slides on the inner surface of the belt 1 and therefore an urging portion thereof is covered with a sliding sheet having good sliding property to decrease frictional resistance belt itself and the belt inner surface, so that the slip of the belt 1 at the time of rotationally driving the roller 2 is prevented. Further, in order to shield the magnetic field generated by the coil 5 so as to prevent the heat generation of the urging member 3, the magnetic shielding core 3*c* is disposed on the upper surface of the urging member 3 over the longitudinal direction. That is, the magnetic shielding core 3*c* is the magnetic shielding means, disposed inside the belt 1 as the image heating member, for preventing an induction magnetic field generated by the electroconductive layer 5 from acting on the stay 3*b* as the supporting member for nip creation. Further, the rotating belt 1 includes the base layer 1*a* formed of metal, so that it is sufficient to provide a flange member 8 for simply stopping the end portion of the belt 1 as a means for regulating lateral movement of the belt 1 with respect to the widthwise direction even when the belt 1 is placed in a rotation state. As a result, there is an advantage such that the constitution of the fixing device can be simplified. In this embodiment, the nip N has a longitudinal direction length Lnip (FIG. 3(*a*)) of 320 mm which is larger than the maximum sheet passing area width Lp of 300 mm. Further, the stay 3*b* has a longitudinal direction length Lst of 360 mm, and the magnetic shielding core 3*c* disposed inside the belt 1 and configured to cover the stay has a length Lic of 320 mm, which is equal to the longitudinal direction length Lnip of the nip N and the length Lr of the roller 2.

4) Induction Heating Device 4

In this embodiment, the belt 1 and the coil 5 of the image heating apparatus 4 are kept in an electrically insulating state by a 0.5 mm-thick mold and are spaced with a constant gap of 1.5 mm (a distance between the mold surface and the fixing belt surface is 1.0 mm), so that the belt 1 is uniformly heated. Here, in this embodiment, LcoilA is an outside distance of bent portions 5*b* and 5*b*, which are end portions of the coil 5 and is 340 mm, and LcoilB, is an inside distance of the bent portions 5*b* and 5*b* and is 316 mm. Further, the outside magnetic core 6*a* has a full length (width) L6*a* of 350 mm, and the central magnetic core 6*b* disposed at the inside hollow portion 5*a* of the coil 5 has a full length (width) L6*b* of 314 mm. As described above, a high-frequency current of 20-50 kHz is applied to the excitation coil 5 from the electric power unit 101, so that the metal layer 1*a* of the belt 1 is subjected to induction heating. Then, the control circuit portion 100 performs temperature control by changing the frequency of the high-frequency current on the basis of a detected value of the temperature sensor TH1 so that the temperature of the belt 1 is kept constant at the target temperature of 180° C. to control the electric power to be input into the coil 5. The image heating apparatus 5 including the coil 5 is disposed outside the belt 1, not inside the belt 1 where the temperature becomes high. As a result, the temperature of the coil 5 is less liable to become a high temperature and its electric resistance is not increased, so that it is possible to alleviate loss due to Joule heat even when the high-frequency current is caused to pass through the coil 5. The disposition of the coil 8 on the outside of the belt 1 also contributes to a reduction in diameter (a reduction in thermal capacity) of the belt 1, and by extension is also excellent in energy saving. The warming-up time of the fixing device A in this embodiment is, because of the constitution of very small thermal capacity, such that the coil temperature can reach the target temperature of 180° C. in about 15 seconds, e.g., when the electric power of 1200 W is input into the coil 5, so that a heating operation during stand-by is not required to be performed. For that reason, it is possible to suppress the electric power consumption amount at a very low level. As described above, the sheet passing of the recording material P in the image forming apparatus in this embodiment is performed by a so-called center(-line) basis conveyance. The sheet passing width of the recording material means a dimension of the recording material with respect to a direction perpendicular to the recording material conveyance direction in the recording material place. The lengths of the various members described in this embodiment mean those when the members are disposed bilaterally equally with respect to the center reference line as the center. Therefore, in the drawings described hereinafter for illustrating the temperature distribution of the belt 1, the bilaterally equal disposition of the members is basically held, and even when the temperature distribution on one side is shown, the temperature distribution on the other side is similar to that on the one side.

That is, the fixing device A includes the rotatable image heating member 1 including the electroconductive layer 1*a* and includes the rotatable pressing member 2 contactable to the other circumferential surface of the image heating member 1. Further, the fixing device A includes the urging member portion 3*a*, disposed inside the image heating member 1, for urging the image heating member 1 toward the pressing member 2 and includes the excitation coil 5 for induction-heating the electroconductive layer 1*a*. The fixing device A is the image heating apparatus in which the recording material P is nip-conveyed in the press-contact portion N created by the press-contact between the image heating member 1 and the pressing member 2 to heat the image on the recording material P.

5) Relationship Among Longitudinal Direction Lengths of Respective Members

As described above, the length of the belt 1 as the image heating member is Lb, the length of the roller 2 as the pressing member is Lr, the outside distance of the bent portions 5*b* and 5*b* which are the end portions of the coil 5 to be induction-heated is LcoilA, and the inside distance of the bent portions 5*b* and 5*b* is LcoilB.

In the fixing device A, these lengths and distances are characterized by satisfying the following relationship:

$$LcoilA \geqq Lb > Lr \geqq LcoilB.$$

Further, the length of the member shielding core 3*c* as the member shielding means disposed inside the belt 1 is Lic. The fixing device 1 in this embodiment is characterized by satisfying both of:

$$LcoilA \geqq Lb > Lr \geqq LcoilB, \text{ and}$$

$$Lr \leqq Lic \geqq LcoilB.$$

When the maximum sheet passing width of the recording material P, having the maximum sheet passing width, used in the fixing device A for sheet passing is Lp, the length Lb of the belt 1 (with respect to the recording material sheet passing width direction) is set at a value which is larger than the sheet passing width Lp, i.e., Lb>Lp. Further, when the full length (width) of the roller 2 is Lr, the roller length Lr is set at a value which is smaller than the belt length Lb and is larger than the sheet passing width Lp, i.e., Lb>Lr>Lp. This is because, as described above, there is need to make the length Lr of the roller 2 smaller than the length Lb of the belt 1 in order to prevent the stress applied from the three members of the urging member portion 3*a*, the flange member 8 and the roller 2 to the end portions of the belt 1. In this embodiment, within the length LcoilA of the coil 5 of the image heating apparatus 4 (with respect to the recording material sheet passing width direction), the belt 1 having the length Lb and the roller 2 having the length Lr are disposed so that their end portions are located outside and inside the bent portions 5*b* and 5*b* of the coil 5, respectively. That is, when the outside distance of the belt portions 5*b* and 5*b* which are the end portions of the coil 5 is LcoilA and the inside distance of the bent portions 5*b* and 5*b* is LcoilB, the relationship: LcoilA≧Lb>Lr≧LcoilB is satisfied. As a result, the temperature rise at the non-contact portions 1*a* and 1*a* of the roller 2 with the belt 1 is prevented, so that the temperature non-uniformity of the belt 1 with respect to the longitudinal direction is reduced.

Figure 5:
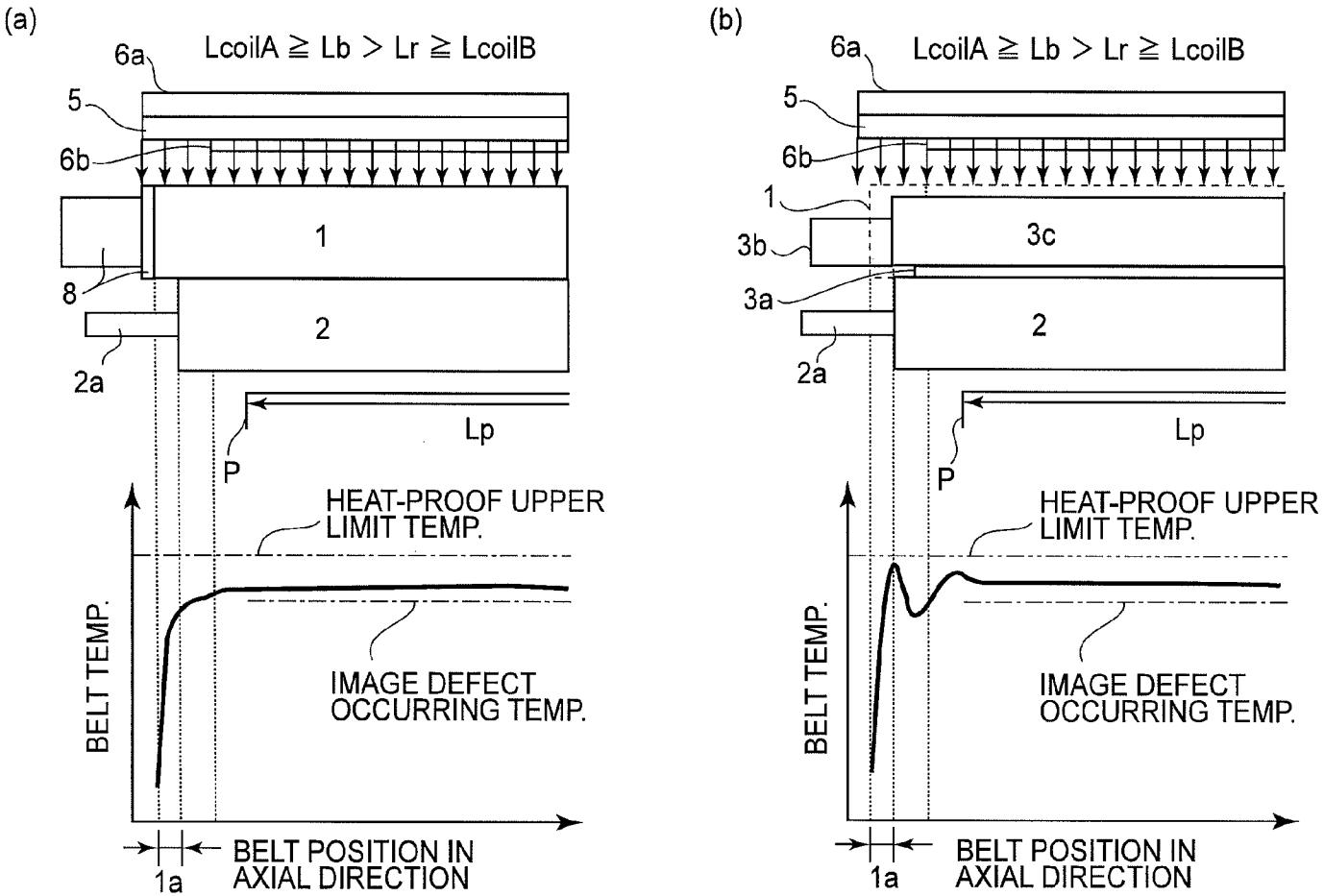
FIG. 5(*a*) is a schematic view showing a relationship between a longitudinal position of the fixing belt and a temperature distribution at the time of completion of warm-up of the fixing device in Embodiment 1, and FIG. 5(*b*) is a schematic view showing a temperature distribution relationship, during continuous sheet passing, of the fixing device configured to satisfy: LcoilA≧Lb>Lr≧LcoilB.
Figure 6:
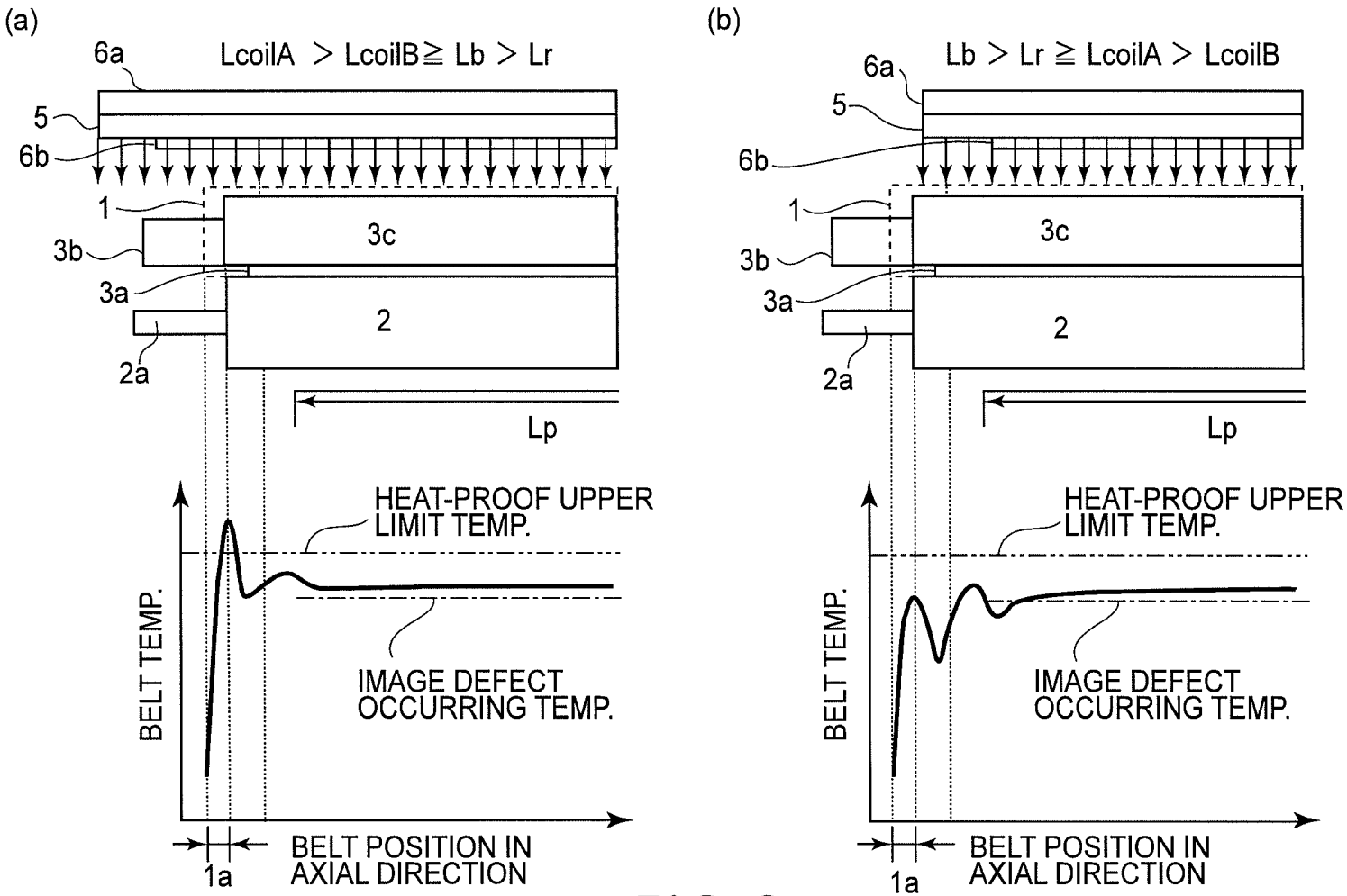
FIG. 6(*a*) is a schematic view showing a temperature distribution relationship, during continuous sheet passing, of the fixing device configured to satisfy: LcoilA>LcoilB≧Lb≧Lr, and FIG. 6(*b*) is a schematic view showing a temperature distribution relationship, during continuous sheet passing, of the fixing device configured to satisfy: Lb>Lr≧LcoilA>LcoilB.

The longitudinal temperature distribution of the belt 1 will be described in association with the lengths (distances) of the respective members. FIG. 5(*a*) shows the temperature distribution of the belt 1 with respect to the longitudinal direction immediately after completion of the warm-up of the fixing device A in this embodiment. FIG. 5(*b*) shows the longitudinal temperature distribution of the belt 1 after the lapse of a period of time from the start of printing after completion of the warm-up of the fixing device A to the continuous sheet passing of 100 sheets in the case where the fixing device A is configured to satisfy: LcoilA≧Lb>Lr≧LcoilB in this embodiment. FIG. 6(*a*) shows the longitudinal temperature distribution of the belt 1 after the lapse of a period of time from the start of printing after completion of the warm-up of the fixing device A to the continuous sheet passing of 100 sheets in the case where the fixing device A is configured to satisfy: LcoilA>LcoilB≧Lb>Lr. FIG. 6(*b*) shows the longitudinal temperature distribution of the belt 1 after the lapse of a period of time from the start of printing after completion of the warm-up of the fixing device A to the continuous sheet passing of 100 sheets in the case where the fixing device A is configured to satisfy: Lb>Lr≧LcoilA>LcoilB.

In FIG. 5(*b*), the longitudinal temperature distribution of the belt 1 does not exceed a heat-proof upper limit temperature at any position and the temperature of the belt 1 in the sheet passing area Lp is kept at a value which is not less than an image defect occurring temperature. For that reason, the toner image on the recording material can be fixed in a suitable state.

In FIG. 6(*a*), the temperature of the belt 1 at the belt end portion exceeds the heat-proof upper limit temperature. This is because the inner end portion of the inside hollow portion 5*a* of the coil 5 extends to the outside of the (outside) end portion of the belt 1. As a result, an abrupt temperature rise occurs at the end portion of the belt 1 and particularly, at the non-contact portion 1*a* where the belt 1 does not contact the roller 2, there is no member for sufficiently permitting heat absorption and heat dissipation. For that reason, the phenomenon that the belt end portion temperature exceeds the heat-proof upper limit temperature occurs due to an unavoidable temperature rise by the continuous sheet passing.

In FIG. 6(*b*), the temperature of the belt 1 in the sheet passing area Lp is below the image defect occurring temperature, so that a so-called cold offset occurs. This phenomenon is caused by an insufficient heat quantity provided by the electromagnetic induction heating, leading to the occurrence of the lowering in temperature within the sheet passing area, since the outside end of the coil 5 is located inside the outside end of the belt 1. On the other hand, the belt 1, the roller 2 and the coil 5 can be disposed to satisfy: Lb>Lr≧LcoilA>LcoilB>Lp in order that the heat area sufficiently larger than the sheet passing area Lp can be ensured. However, in this case, the length of the belt 1 is considerably longer than that in the constitution in this embodiment, so that an increase in size of the apparatus and an increase in cost of the belt 1 are undesirably caused.

On the other hand, in the fixing device configured to satisfy the relationship: LcoilA≧Lb>Lr≧LcoilB as described in this embodiment with reference to FIGS. 5(*a*) and 5(*b*), it is possible to minimize the lengths of the belt 1, the roller 2 and the coil 5. For that reason, the constitution is also advantageous from the viewpoint of energy saving, and cost reduction and the minimization of disposition space can be realized by downsizing of the members, so that it becomes possible to provide a preferable electrophotographic image forming apparatus for the user.

Further, the magnetic shielding core 3*c* disposed inside the belt 1 has the function of strengthening the magnetic field generated from the coil 5. For that reason, the magnetic shielding core 3*c* is configured to be disposed inside the end portions of the roller 2 so that the relationship; Lr≧Lic≧LcoilB is satisfied in order that the non-sheet-passing portion can be prevented from causing abnormal temperature rise and the heat generating area at the central portion of the belt can be uniformized. That is, the full length Lr of the roller 2, the length Lric of the magnetic shielding core 3*c*, and the inside distance LcoilB of the bent portions 5*b* and 5*b* which are the end portions of the excitation coil 5 are configured to satisfy the relationship of: Lr≧Lic≧LcoilB. As a result, the occurrence of an image defect is prevented by decreasing the fluctuation range of the temperature distribution, so that it is possible to provide a fixing device suitable from the viewpoints of the energy saving and the size reduction.

Embodiment 2

Figure 7:
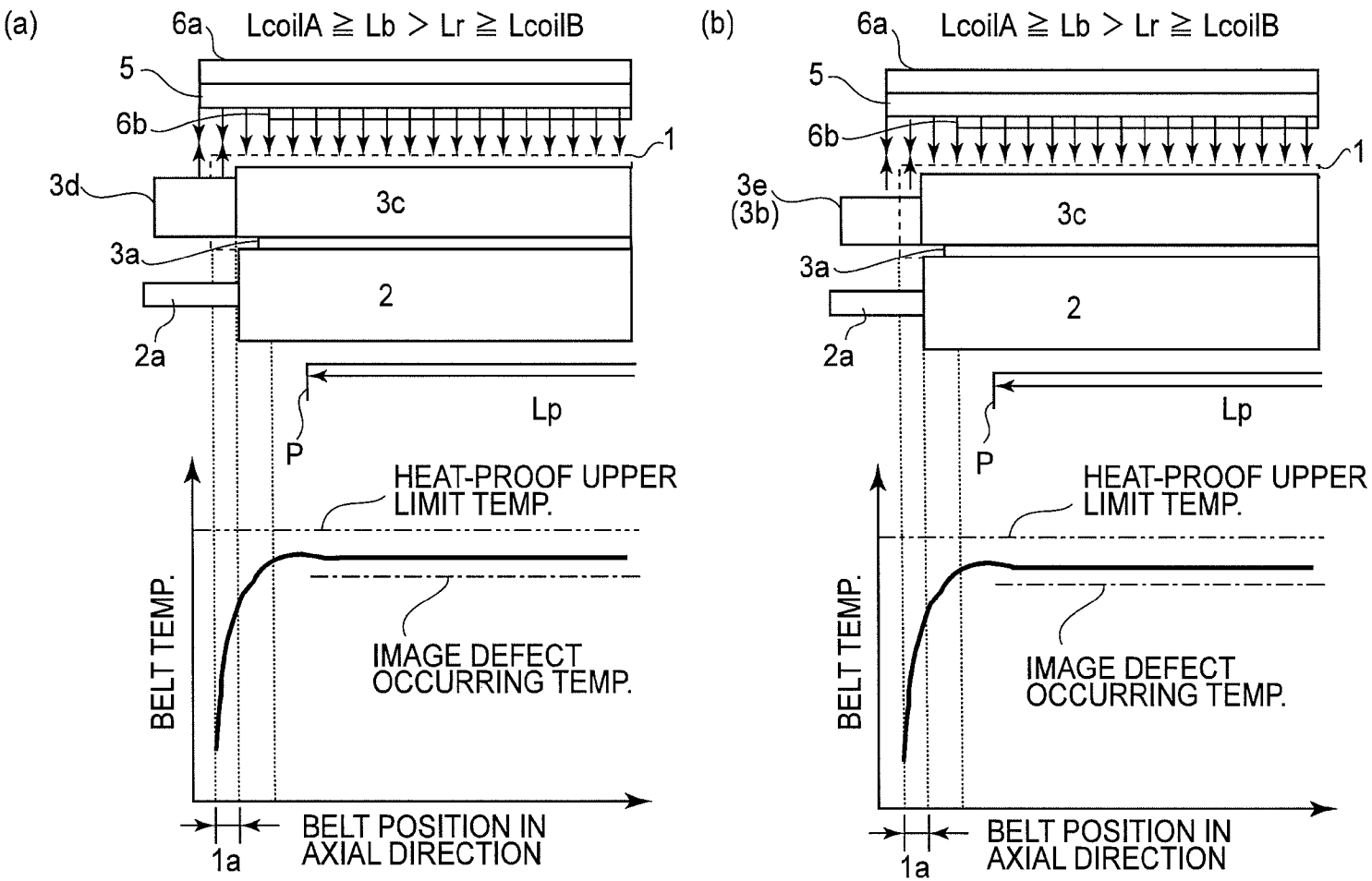
FIG. 7(*a*) is a schematic view showing a temperature distribution relationship, during continuous sheet passing, of the fixing device including a non-magnetic electroconductive member held by a support member for nip creation in Embodiment 2, and FIG. 7(*b*) is a schematic view showing a temperature distribution relationship, during continuous sheet passing, of the fixing device including a non-magnetic electroconductive member stay in Embodiment 3.

FIG. 7(*a*) is a schematic sectional view showing one end portion of the fixing device in this embodiment and shows the longitudinal temperature distribution of the belt 1 after the lapse of a period of time from the start of printing after completion of the warm-up of the fixing device to the continuous sheet passing of 100 sheets. In the figure, a magnetic field cancelling member 3*d*, which is a non-magnetic electroconductive member in this embodiment, is disposed inside the flange member 8. That is, this embodiment is characterized in that the magnetic field cancelling member 3*d*, which is a non-magnetic electroconductive member, is held by the end portion of the supporting member 3*b* for nip creation and the end portion position of the magnetic field cancelling member 3*d* on the sheet passing area side with respect to a pressure axis direction of the cancelling member 3*d* is vertically aligned with the end portion position of the roller 2 or is located outside the end portion position of the roller 2. The magnetic field cancelling member 3*d* may preferably be formed of copper, gold, silver, non-magnetic stainless steel, or the like and may preferably have a thickness of 300 μm or more, and further preferably about 1 mm. With respect to the position in which the magnetic field cancelling member 3*d* is disposed, as described in Embodiment 1, when the respective members of the fixing device are configured to satisfy the relationship of: LcoilA≧Lb>Lr≧LcoilB, the magnetic field cancelling member 3*d* is disposed in the following manner. In order not to prevent the temperature rise in the inner area of the belt 1 while preventing the temperature rise at the belt portion 1*a* which does not contact the roller 2, the inside end portion position of the magnetic field cancelling member 3*d* is vertically aligned substantially with the end portion position of the roller 2 or is located outside the end portion position of the roller 2. As a result, as shown in FIG. 7(*a*), the fluctuation range of the temperature distribution of the belt 1 is decreased to prevent the occurrence of an image defect, so that it is possible to provide a suitable fixing device from the viewpoints of energy saving and size reduction.

Embodiment 3

FIG. 7(*b*) is a schematic sectional view showing one end portion of the fixing device in this embodiment and shows the longitudinal temperature is distribution of the belt 1 after the lapse of a period of time from the start of printing after completion of the warm-up of the fixing device to the continuous sheet passing of 100 sheets. In the figure, a magnetic field cancelling stay 3*e*, which is a non-magnetic electroconductive member in this embodiment, is disposed. That is, this embodiment is characterized in that the supporting member 3*b* for nip creation is constituted by the magnetic field cancelling stay 3*e* (non-magnetic electroconductive member). The magnetic field cancelling stay 3*e* is required to have strength to the extent such that the amount of bending against a load exerted on the fixing device is suppressed at a certain level or less and may preferably be formed of austenitic stainless steel such as non-magnetic SUS 304 or SUS 318. In this embodiment, SUS 318 which less causes magnetization by processing thereof. As shown in FIG. 7(*b*), when the respective members of the fixing device are configured to satisfy the relationship of: LcoilA≧Lb>Lr≧LcoilB, the magnetic field cancelling stay 3*d* performs the following function. That is, by the magnetic field cancelling stay 3*e* outwardly exposed from the magnetic shielding core 3*c*, the magnetic field of the temperature rise portion at the belt portion 1*a* which does not contact the roller 2 is cancelled. As a result, as shown in FIG. 7(*b*), the fluctuation range of the temperature distribution of the belt 1 is decreased to prevent the occurrence of an image defect, so that it is possible to provide a suitable fixing device from the viewpoints of energy saving and size reduction.

The image heating apparatus of the present invention can be used as not only the image heating apparatus (fixing devices) in the above-described Embodiments 1 to 3 but also other image heating apparatuses including, e.g., an image heating apparatus for modifying a surface property, such as gloss, by heating a recording material which carries an image, an image heating apparatus for temporary fixation, and the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 188458/2009 filed Aug. 17, 2009, which is hereby incorporated by reference.

What is claimed is:

1. An image heating apparatus comprising:

a rotatable image heating member including an electroconductive layer;

a pressing member, press-contacting said image heating member, configured to form a nip in which an image on a recording material is to be heated;

an urging member, provided inside said image heating member, configured to urge said image heating member toward said pressing member; and an excitation coil configured to cause induction-heating of the electroconductive layer, wherein when a length of said image heating member with respect to a rotational axis direction of said image heating member is Lb, a length of said pressing member with respect to the rotational axis direction is Lr, an outside distance of bent portions of said excitation coil at both end portions of said excitation coil with respect to the rotational axis direction is LcoilA, and an inside distance of the bent portions with respect to the rotational axis direction is LcoilB, the lengths Lb and Lr and the distances LcoilA and LcoilB satisfy the following relationship:

$$LcoilA>Lb>Lr>LcoilB.$$

2. An apparatus according to claim 1, further comprising a supporting member configured to support said pressing member and magnetic shielding means for shielding said supporting member from magnetic flux from said excitation coil, wherein when a length of said magnetic shielding means is Lic, the following relationship is satisfied:

$$Lr>Lic>LcoilB.$$

3. An apparatus according to claim 2, wherein said supporting member is a non-magnetic electroconductive member.

4. An apparatus according to claim 1, wherein a non-magnetic electroconductive member is held at an end portion of said supporting member and an end position of the non-magnetic electroconductive member on a recording material passing area side of said apparatus with respect to the rotational axis direction is vertically aligned with or located outside an associated end position of said pressing member.

5. An image forming apparatus comprising:

image forming means for forming an unfixed toner image on the recording material; and an image heating apparatus according to claim 1, wherein said image heating apparatus heats the unfixed toner image formed on the recording material.

* * * * *